US009459550B2

(12) United States Patent
Kawahara et al.

(10) Patent No.: US 9,459,550 B2
(45) Date of Patent: Oct. 4, 2016

(54) APPLYING DEVICE AND IMAGE FORMING APPARATUS

(71) Applicant: FUJI XEROX CO., LTD., Tokyo (JP)

(72) Inventors: Ichiro Kawahara, Kanagawa (JP); Hiroki Ando, Kanagawa (JP); Mikio Yamaguchi, Kanagawa (JP); Hirofumi Iida, Kanagawa (JP); Keishi Araki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/613,986

(22) Filed: Feb. 4, 2015

(65) Prior Publication Data

US 2015/0261114 A1 Sep. 17, 2015

(30) Foreign Application Priority Data

Mar. 12, 2014 (JP) ..... 2014-049112

(51) Int. Cl.
*G03G 15/02* (2006.01)

(52) U.S. Cl.
CPC ..... *G03G 15/0233* (2013.01); *G03G 15/0216* (2013.01)

(58) Field of Classification Search
USPC ..... 399/176
See application file for complete search history.

(56) References Cited

U.S. PATENT DOCUMENTS 5,822,169 A * 10/1998 Yoshioka ..... G03G 15/0216 361/225
6,374,071 B1 * 4/2002 Sato ..... G03G 15/167 361/225
2009/0162092 A1 * 6/2009 Hoshio ..... G03G 15/0225 399/100

FOREIGN PATENT DOCUMENTS

JP H02239271 A 9/1990
JP H05-273844 A 10/1993

* cited by examiner

*Primary Examiner* — Minh Phan
(74) *Attorney, Agent, or Firm* — Oliff PLC

(57) ABSTRACT

An applying device includes an applying member and a contact member. The applying member applies voltage to an image bearing member and has an elastic layer and an endless surface layer. The elastic layer is disposed facing the image bearing member, is rotatable about a rotation axis, and is composed of a foam material. The surface layer surrounds an outer periphery of the elastic layer, is supported by the elastic layer in a non-bonded state, and is rotatable together therewith. The contact member comes into contact with the surface layer at an upstream side, in a rotational direction of the applying member, relative to an imaginary line segment connecting a rotation axis of the image bearing member and the rotation axis of the applying member, so as to apply tension to the surface layer at a contact position between the image bearing member and the applying member.

5 Claims, 3 Drawing Sheets

APPLYING DEVICE AND IMAGE FORMING APPARATUS

CROSS-REFERENCE TO RELATED APPLICATIONS

This application is based on and claims priority under 35 USC 119 from Japanese Patent Application No. 2014-049112 filed Mar. 12, 2014.

BACKGROUND

Technical Field

The present invention relates to applying devices and image forming apparatuses.

SUMMARY

According to an aspect of the invention, there is provided an applying device including an applying member and a contact member. The applying member applies voltage to an image bearing member and has an elastic layer and an endless surface layer. The elastic layer is disposed facing the image bearing member, is supported in a rotatable manner about a rotation axis, and is composed of a foam material. The surface layer is disposed so as to surround an outer periphery of the elastic layer, is supported by the elastic layer in a non-bonded state, and is rotatable together with the elastic layer. The contact member comes into contact with the surface layer at an upstream side, in a rotational direction of the applying member, relative to an imaginary line segment that connects a rotation axis of the image bearing member and the rotation axis of the applying member, so as to apply tension to the surface layer at a contact position between the image bearing member and the applying member.

BRIEF DESCRIPTION OF THE DRAWINGS

Exemplary embodiments of the present invention will be described in detail based on the following figures, wherein.

DETAILED DESCRIPTION

Figure 1:
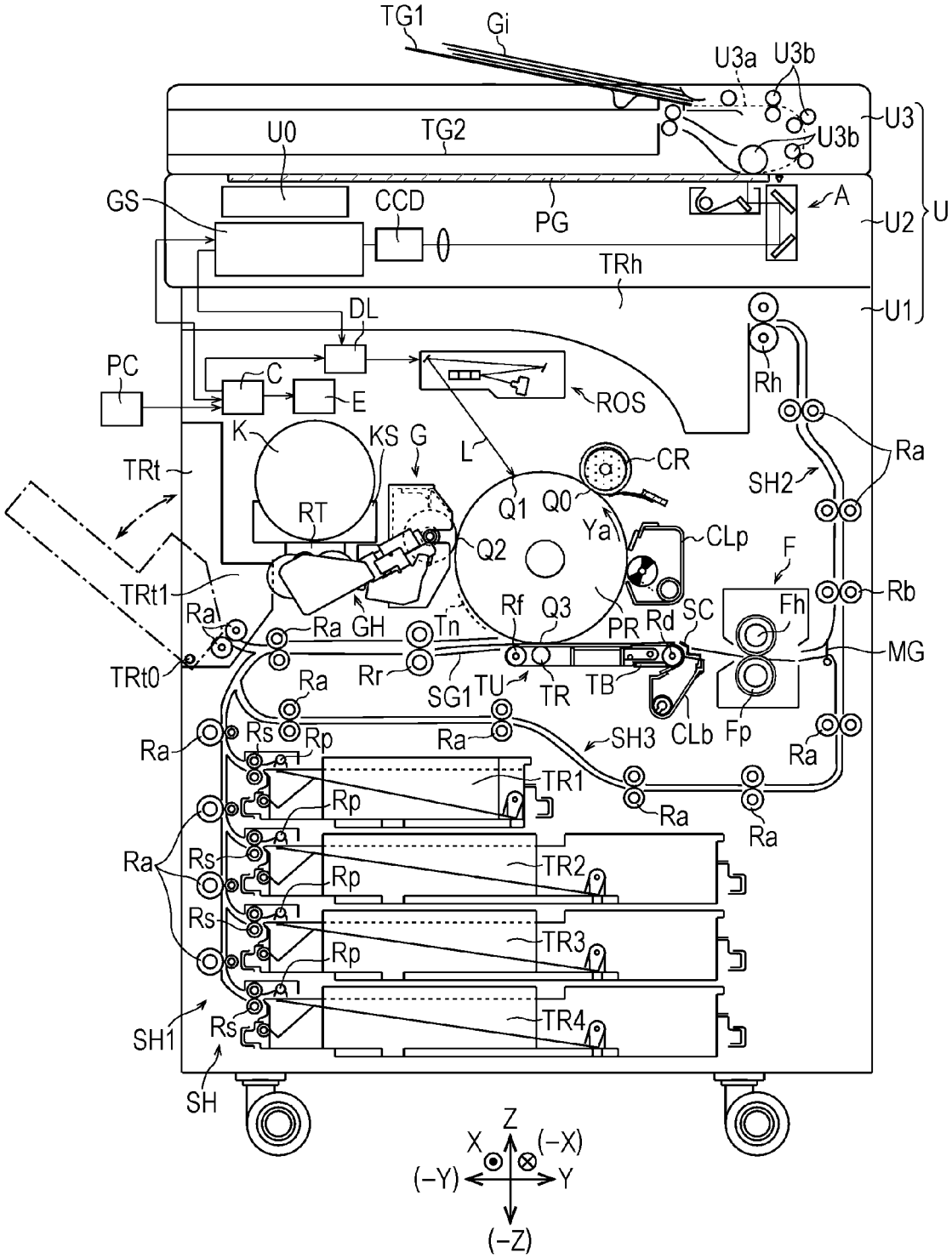
FIG. 1 illustrates an image forming apparatus according to a first exemplary embodiment.

Although specific exemplary embodiments of the present invention will be described below with reference to the drawings, the present invention is not to be limited to the following exemplary embodiments.

In order to provide an easier understanding of the following description, the front-rear direction will be defined as "X-axis direction" in the drawings, the left-right direction will be defined as "Y-axis direction", and the up-down direction will be defined as "Z-axis direction". Moreover, the directions or the sides indicated by arrows X, −X, Y, −Y, Z, and −Z are defined as forward, rearward, rightward, leftward, upward, and downward directions, respectively, or as front, rear, right, left, upper, and lower sides, respectively.

Furthermore, in each of the drawings, a circle with a dot in the center indicates an arrow extending from the far side toward the near side of the plane of the drawing, and a circle with an "x" therein indicates an arrow extending from the near side toward the far side of the plane of the drawing.

In the drawings used for explaining the following description, components other than those for providing an easier understanding of the description are omitted where appropriate.

First Exemplary Embodiment

FIG. 1 illustrates an image forming apparatus according to a first exemplary embodiment.

In FIG. 1, a copier U as an example of the image forming apparatus according to the first exemplary embodiment of the present invention has a printer section U1 as an example of a recording section as well as an example of an image recording device. A scanner section U2 as an example of a reading section as well as an example of an image reading device is supported above the printer section U1. An auto-feeder U3 as an example of a document transport device is supported above the scanner section U2. The scanner section U2 according to the first exemplary embodiment supports a user interface U0 as an example of an input section. An operator may perform input operation on the user interface U0 so as to operate the copier U.

A document tray TG1 as an example of a medium container is disposed at an upper part of the auto-feeder U3. The document tray TG1 is capable of accommodating a stack of multiple documents Gi to be copied. A document output tray TG2 as an example of a document output section is formed below the document tray TG1. Document transport rollers U3*b* are arranged along a document transport path U3*a* between the document tray TG1 and the document output tray TG2.

Platen glass PG as an example of a transparent document table is disposed at the upper surface of the scanner section U2. In the scanner section U2 according to the first exemplary embodiment, a read optical system A is disposed below the platen glass PG. The read optical system A according to the first exemplary embodiment is supported in a movable manner in the left-right direction along the lower surface of the platen glass PG. Normally, the read optical system A is stationary at an initial position shown in FIG. 1.

An imaging element (charge-coupled device (CCD)) as an example of an imaging member is disposed to the left of the read optical system A. The imaging element CCD is electrically connected to an image processor GS.

The image processor GS is electrically connected to a write circuit DL in the printer section U1. The write circuit DL is electrically connected to an exposure device ROS as an example of a latent-image forming device.

A photoconductor drum PR as an example of an image bearing member is disposed below the exposure device ROS. The photoconductor drum PR rotates in a direction indicated by an arrow Ya.

In a charge region Q0, the photoconductor drum PR is disposed facing a charging roller CR as an example of a charging member.

The charging roller CR receives charge voltage from a power supply circuit E. The power supply circuit E is controlled by a controller C as an example of a control unit. The controller C performs various kinds of control by exchanging signals with, for example, the image processor GS and the write circuit DL. Furthermore, the controller C according to the first exemplary embodiment is connected to a personal computer PC, as an example of an information transmitting apparatus, via a connection line for transmitting and receiving information to and from the copier U. The controller C receives image information to be printed, which is transmitted from the personal computer PC.

In a write region Q1 set downstream of the charge region Q0 in the rotational direction of the photoconductor drum PR, a laser beam L as an example of write light is radiated onto the surface of the photoconductor drum PR from the exposure device ROS.

In a development region Q2 set downstream of the write region Q1 in the rotational direction of the photoconductor drum PR, a developing device G is disposed facing the surface of the photoconductor drum PR.

A cartridge K as an example of a developer container is disposed to the left of the developing device G. The cartridge K is detachably attached to a cartridge holder KS as an example of a container support member. A reservoir tank RT as an example of a temporary developer retainer is disposed below the cartridge holder KS. The reservoir tank RT and the developing device G are connected to each other by a developer transport device GH.

A transfer region Q3 is set downstream of the development region Q2 in the rotational direction of the photoconductor drum PR.

Feed trays TR1 to TR4 as an example of medium containers are detachably supported at a lower part of the printer section U1. The feed trays TR1 to TR4 accommodate sheets S as an example of media.

A pickup roller Rp as an example of a medium fetching member is disposed at the upper left side of each of the feed trays TR1 to TR4. A separating roller Rs as an example of a separating member is disposed to the left of the pickup roller Rp.

A medium transport path SH1 that extends upward is formed to the left of the feed trays TR1 to TR4. Multiple transport rollers Ra as an example of medium transport members are arranged along the transport path SH1. In the transport path SH1, a registration roller Rr as an example of a delivering member is disposed in a downstream area in a transport direction of a sheet S as well as upstream of the transfer region Q3.

A manual feed tray TRt as an example of a medium container as well as a manual feeder is disposed to the left of, for example, the cartridge holder KS. The manual feed tray TRt according to the first exemplary embodiment is supported in a rotatable manner about a rotation axis TRt0. Therefore, the manual feed tray TRt is movable between a stowed position indicated by a solid line in FIG. 1 and a feedable position indicated by a dotted chain line in FIG. 1. When the manual feed tray TRt according to the first exemplary embodiment is moved to the stowed position, the manual feed tray TRt is stowed such that a portion TRt1 thereof is located below the cartridge holder KS as well as to the left of the reservoir tank RT. Therefore, the entire copier U is reduced in size owing to a space-saving structure.

In the transfer region Q3, a transfer unit TU as an example of a transfer device as well as an example of a medium transport device is disposed below the photoconductor drum PR. The transfer unit TU has an endless transfer belt TB as an example of a medium transport member.

The transfer belt TB is rotatably supported by a drive roller Rd as an example of a drive member and also by a driven roller Rf as an example of a driven member.

A transfer roller TR as an example of a transfer device is supported within the transfer belt TB. The transfer roller TR is disposed facing the photoconductor drum PR with the transfer belt TB interposed therebetween. Therefore, a region where the transfer roller TR and the photoconductor drum PR face each other constitutes the transfer region Q3. The transfer roller TR receives transfer voltage from the power supply circuit E.

A peeling claw SC as an example of a medium peeling member is disposed at the right end of the transfer belt TB. A belt cleaner CLb as an example of a transfer-device cleaner is disposed below the peeling claw SC so as to face the surface of the transfer belt TB.

A drum cleaner CLp as an example of an image-bearing-member cleaner is disposed downstream of the transfer region Q3 in the rotational direction of the photoconductor drum PR so as to face the surface of the photoconductor drum PR. In the first exemplary embodiment, the photoconductor drum PR, the charging roller CR, and the drum cleaner CLp constitute a drum unit as an example of a detachable unit and are formed as a single unit that is detachable and replaceable relative to the copier U.

A fixing device F as an example of a heat source member is disposed to the right of the transfer unit TU. The fixing device F has a heating roller Fh as an example of a rotatable heating member and a pressing roller Fp as an example of a rotatable pressing member.

An upwardly-extending output path SH2 as an example of a medium transport path is connected to the right side of the fixing device F.

In the output path SH2, a medium-transportable transport roller Rb and a medium-transportable output roller Rh, which are rotatable in forward and reverse directions, are arranged as examples of medium transport members.

An output tray TRh as an example of a medium output portion is formed at the upper surface of the printer section U1.

An inversion path SH3 as an example of a medium transport path is formed below the output path SH2. The inversion path SH3 according to the first exemplary embodiment branches off from the output path SH2, extends downward, and then merges with the transport path SH1 at the upstream side of the registration roller Rr in the sheet transport direction.

A gate MG as an example of a transport-direction switching member is disposed at the branch portion between the output path SH2 and the inversion path SH3. The gate MG according to the first exemplary embodiment is formed of a so-called thin elastically-deformable film. In a case where a sheet S transported from the fixing device F passes through the gate MG, the gate MG elastically deforms by being pressed by the sheet S so as to allow the sheet S to travel to the output path SH2. In a case where the sheet S is to be transported from the output path SH2 to the inversion path SH3, the gate MG is maintained in an elastically restored state so as to prevent the sheet S from entering toward the fixing device F, thereby guiding the sheet S toward the inversion path SH3.

Image Forming Operation

The multiple documents Gi accommodated in the document tray TG1 sequentially pass through a document read position on the platen glass PG and are output onto the document output tray TG2.

If copying is to be performed by transporting the documents by using the auto-feeder U3, the read optical system A stays stationary at its initial position and exposes the documents Gi sequentially passing through the read position on the platen glass PG to light.

If copying is to be performed by allowing an operator to manually place a document Gi on the platen glass PG, the read optical system A moves in the left-right direction so as to scan the document on the platen glass PG while exposing the document to light.

Reflected light from the document Gi is focused onto the imaging element CCD via the read optical system A. The imaging element CCD converts the reflected light of the document focused on an imaging surface into an electric signal.

The image processor GS converts the read signal input from the imaging element CCD into a digital image signal and outputs the signal to the write circuit DL in the printer section U1. The write circuit DL outputs a control signal according to the input image write signal to the exposure device ROS.

In the charge region Q0, the surface of the photoconductor drum PR is electrostatically charged by the charging roller CR. In the electrostatic-image write region Q1, the laser beam L output from the exposure device ROS forms an electrostatic latent image on the surface of the photoconductor drum PR. In the development region Q2, the developing device G develops the electrostatic latent image on the photoconductor drum PR passing through the development region Q2 into a toner image Tn as an example of a visible image. When the developer is consumed by the developing device G, the developer transport device GH operates in accordance with the consumed amount and resupplies the developing device G with the developer from the cartridge K.

A sheet S from one of the trays TR1 to TR4 is fetched by the pickup roller Rp at a predetermined feed timing. If multiple stacked sheets S are fetched by the pickup roller Rp, the sheets S are separated from each other one-by-one by the separating roller Rs. The sheet S having passed through the separating roller Rs is transported to the registration roller Rr by the multiple transport rollers Ra.

A sheet S fed from the manual feed tray TRt also merges with the transport path SH1 so as to be transported to the registration roller Rr.

The sheet S transported to the registration roller Rr is transported from a pre-transfer sheet guide SG1, as an example of a pre-transfer guide member, to the transfer region Q3 in accordance with the timing at which the toner image on the surface of the photoconductor drum PR is transported to the transfer region Q3.

The sheet S transported from the registration roller Rr passes through the transfer region Q3 while being supported by the surface of the transfer belt TB. The toner image Tn on the surface of the photoconductor drum PR is transferred onto the sheet S passing through the transfer region Q3 in accordance with transfer voltage applied to the transfer roller TR.

After the surface of the photoconductor drum PR passes through the transfer region Q3, the drum cleaner CLp removes residual toner therefrom so as to clean the surface. The cleaned surface of the photoconductor drum PR is electrostatically charged again by the charging roller CR.

The sheet S having the toner image Tn transferred thereon is peeled off from the transfer belt TB by the peeling claw SC. With regard to the transfer belt TB from which the sheet S has been peeled off, extraneous matter, such as the developer and paper particles, adhered on the surface of the transfer belt TB is removed therefrom by the belt cleaner CLb. As the sheet S peeled off from the transfer belt TB passes through a contact region between the heating roller Fh and the pressing roller Fp, the toner image is heated and pressed so as to become fixed onto the sheet S.

The sheet S having the toner image fixed thereon passes through the gate MG while elastically deforming the gate MG, so as to be transported to the output path SH2. If the sheet S is to be output onto the output tray TRh, the sheet S is transported by the transport roller Rb and is output onto the output tray TRh by the output roller Rh.

If duplex printing is to be performed, the sheet S having the toner image already printed on one face thereof is transported downstream by the transport roller Rb and the output roller Rh until the trailing edge of the sheet S passes through the gate MG. Once the trailing edge of the sheet S passes through the gate MG, the transport roller Rb and the output roller Rh rotate in the reverse direction so as to transport the sheet S from the output path SH2 toward the inversion path SH3. In other words, the transport direction of the sheet S is reversed so that the sheet S is switched back. The switched-back sheet S is transported along the inversion path SH3 by being guided by the gate MG. The sheet S transported along the inversion path SH3 merges with the transport path SH1 and is transported to the registration roller Rr in a state where the front and rear faces of the sheet S are inverted. Then, in the transfer region Q3, an image is printed onto the second face of the sheet S.

Charging Device

Figure 2:
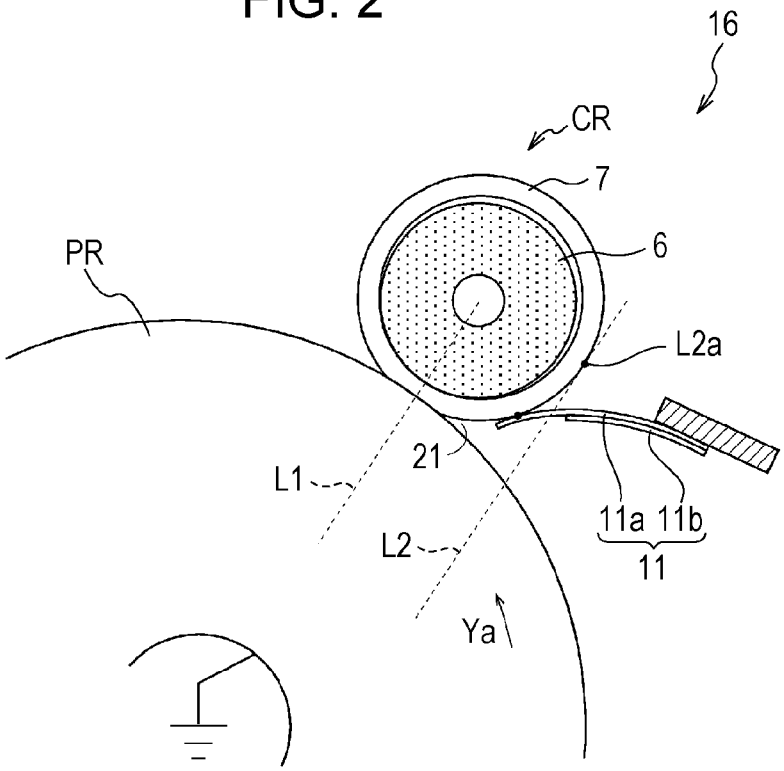
FIG. 2 illustrates a relevant part of a charging device according to the first exemplary embodiment.

FIG. 2 illustrates a relevant part of a charging device according to the first exemplary embodiment.

Figure 3:
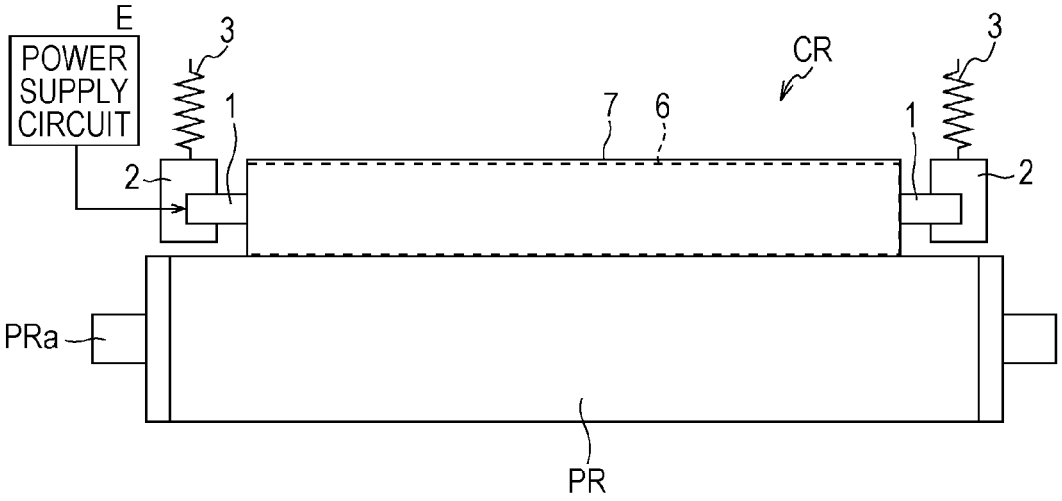
FIG. 3 is a side view of the charging device and an image bearing member according to the first exemplary embodiment.

FIG. 3 is a side view of the charging device and the image bearing member according to the first exemplary embodiment.

In FIGS. 2 and 3, the charging roller CR according to the first exemplary embodiment has a rotation shaft 1 as an example of a rotation axis. The rotation shaft 1 has front and rear ends that are rotatably supported by bearings 2. The bearings 2 are pressed toward the photoconductor drum PR by springs 3 as an example of pressing members. Thus, the charging roller CR is pressed against the photoconductor drum PR. The rotation shaft 1 receives charge voltage from the power supply circuit E.

The rotation shaft 1 supports an elastic layer 6. The elastic layer 6 according to the first exemplary embodiment is formed in a shape of a roller extending in the front-rear direction. Furthermore, in the first exemplary embodiment, foamable ethylene-propylene-diene (EPDM) rubber as an example of a foam material is used as the elastic layer 6.

A surface layer 7 is disposed around the outer periphery of the elastic layer 6. The surface layer 7 according to the first exemplary embodiment is formed of an endless tube having an inner diameter that is larger than the outer shape of the elastic layer 6. The surface layer 7 is disposed so as to surround the outer periphery of the elastic layer 6. Moreover, the surface layer 7 is supported by the elastic layer 6 in a non-bonded state. In the first exemplary embodiment, nylon or polyamide with a thickness of about 0.1 mm to 0.2 mm is used as the surface layer 7.

The elastic layer 6 and the surface layer 7 constitute the charging roller CR, which is an example of a charging member according to the first exemplary embodiment as well as an example of an applying member.

Because the elastic layer 6 is pressed toward the photoconductor drum PR by the springs 3, the surface layer 7 comes into surface contact with the photoconductor drum PR as the elastic layer 6 elastically deforms, so that the surface layer 7 receives contact pressure at the position where the surface layer 7 is in contact with the photoconductor drum PR. Therefore, as the photoconductor drum PR rotates, the surface layer 7 rotates together with the elastic layer 6. Although the charging roller CR according to the first exemplary embodiment has a rotationally-driven configuration as an example, a rotationally-driving configuration is also permissible by connecting a drive source, such as a motor, to the charging roller CR.

Figure 4:
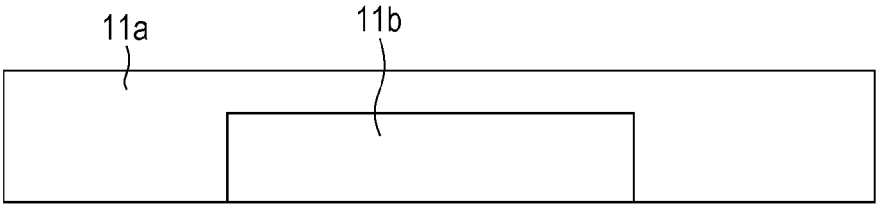
FIG. 4 illustrates a contact member according to the first exemplary embodiment.

FIG. 4 illustrates a contact member according to the first exemplary embodiment.

In FIG. 2, the charging roller CR according to the first exemplary embodiment is in contact with an abutment film 11 as an example of a contact member. The abutment film 11 according to the first exemplary embodiment is composed of polyethylene terephthalate (PET) resin as an example of an elastic film material. Furthermore, the abutment film 11 according to the first exemplary embodiment is disposed such that the abutment film 11 elastically deforms in a state where an end thereof is in contact with the surface layer 7. Thus, the abutment film 11 is supported in a state where the abutment film 11 applies contact pressure to the surface layer 7. In FIG. 4, the abutment film 11 according to the first exemplary embodiment has a thin-film-shaped body portion 11*a* extending in the front-rear direction and a thin-film-shaped reinforcement portion 11*b* disposed at the midsection of the abutment film 11 in the front-rear direction. The reinforcement portion 11*b* is bonded to the body portion 11*a* by using, for example, an adhesive. Therefore, in the abutment film 11 according to the first exemplary embodiment, the rigidity at the midsection is higher than the rigidity at the opposite ends in the front-rear direction. Thus, the contact pressure with which the abutment film 11 comes into contact with the surface layer 7 is higher at the midsection than at the opposite ends.

In FIG. 2, the contact position between the abutment film 11 and the surface layer 7 in the first exemplary embodiment is set upstream, in the rotational direction of the charging roller CR, relative to an imaginary line segment L1 that connects a rotation axis PRa of the photoconductor drum PR and the rotation shaft 1 of the charging roller CR. In particular, the abutment film 11 according to the first exemplary embodiment is in contact with the surface layer 7 at the rotation axis PRa side of the photoconductor drum PR relative to a contact point L2*a*, which is located upstream, in the rotational direction of the charging roller CR, of the charge region Q0 serving as the contact position between the charging roller CR and the photoconductor drum PR and is where a second imaginary line segment L2 parallel to the imaginary line segment L1 comes into contact with the charging roller CR.

The charging roller CR, the abutment film 11, and so on constitute a charging device 16 as an example of an applying device according to the first exemplary embodiment.

Operation of Charging Device

In the copier U according to the first exemplary embodiment having the above-described configuration, the charging roller CR electrostatically charges the photoconductor drum PR in the charge region Q0. In the first exemplary embodiment, the elastic layer 6 composed of a foam material is provided, and the elastic layer 6 is elastically deformed readily by the elastic force of the springs 3 so that a wide surface may be ensured as the charge region Q0. On the other hand, in a case where the elastic layer 6 composed of a foam material is directly brought into contact with the photoconductor drum PR, spaces formed as a result of the foam in the surface of the elastic layer 6 come into contact with the photoconductor drum PR, thus causing the electrical characteristics to vary between space areas and non-space areas. This results in a variation in charge results. In contrast, by disposing the surface layer 7 having a smooth surface around the surface of the elastic layer 6, the contact area between the photoconductor drum PR and the surface layer 7 is made uniform, thereby readily achieving stable charging. If the surface layer 7 and the elastic layer 6 were to be bonded to each other, the number of manufacturing steps increases, resulting in an increase in manufacturing cost. Therefore, with the charging roller CR in which the elastic layer 6 and the surface layer 7 are not bonded to each other, the manufacturing cost may be readily reduced, as compared with a case where the two layers are bonded to each other.

Figure 5:
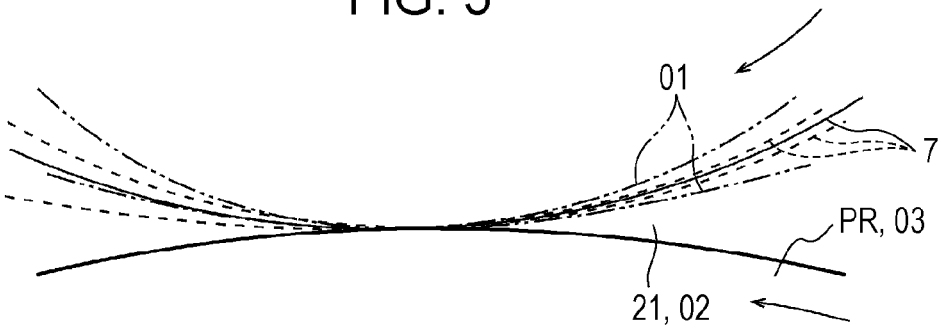
FIG. 5 illustrates the operation according to the first exemplary embodiment.

FIG. 5 illustrates the operation according to the first exemplary embodiment.

In FIG. 5, when the charging roller CR is to electrostatically charge the photoconductor drum PR, the charging roller CR electrostatically charges the surface of the photoconductor drum PR in accordance with discharging in cuneiform-shaped spaces 21 located upstream and downstream of the contact position between the charging roller CR and the photoconductor drum PR. In other words, when the state in the cuneiform-shaped spaces 21 changes, the charging performance changes.

In the configuration in the related art in which the abutment film 11 is not provided, a surface layer 01 vibrates. In other words, the behavior of the surface layer 01 is unstable. Thus, in the related art, the size of spaces 02 fluctuates, as denoted by a two-dot chain line in FIG. 5, making it difficult to achieve stable charging performance. Therefore, there is a possibility that charge detects or excessive charging may occur, possibly resulting in non-uniform charging of the surface of a photoconductor drum 03.

In contrast, in the first exemplary embodiment, the abutment film 11 is in contact with the surface layer 7 at the upstream side of the charge region Q0. Therefore, as the abutment film 11 comes into contact with the surface layer 7, the abutment film 11 becomes resistance against the rotation of the surface layer 7 at the contact position between the abutment film 11 and the surface layer 7. In other words, the abutment film 11 applies a brake on the surface layer 7. In this state, tension is applied to an area between the charge region Q0, which is the contact position between the surface layer 7 and the photoconductor drum PR, and the contact position between the surface layer 7 and the abutment film 11, thus causing the surface layer 7 to be in a tensile state. Therefore, as indicated by a dash line in FIG. 5, the behavior of the surface layer 7 may be readily made stable, as compared with a case where the abutment film 11 is not provided. Consequently, fluctuations of the cuneiform-shaped spaces 21 may be suppressed. Thus, the charge region Q0, which is a region where the photoconductor drum PR and the charging roller CR face each other, becomes stable. Accordingly, the charging performance of the charging roller CR may be made stable, so that non-uniform charging of the photoconductor drum PR may be reduced.

Furthermore, in the first exemplary embodiment, the abutment film 11 is in contact with the surface layer 7 at the rotation axis PRa side of the photoconductor drum PR relative to the contact point L2*a*. In a case where the abutment film 11 is brought into contact with the surface layer 7 at a position farther away from the rotation axis PRa of the photoconductor drum PR relative to the contact point L2*a*, the distance from the contact position between the abutment film 11 and the surface layer 7 to the charge region Q0 increases, possibly causing an intermediate area of the surface layer 7 to slack. In contrast, in the first exemplary embodiment, the distance from the contact position between the abutment film 11 and the surface layer 7 to the charge region Q0 is short, so that the behavior of the surface layer 7 may be readily made stable.

Furthermore, in the first exemplary embodiment, with regard to the abutment film 11, the contact pressure at the midsection thereof in the front-rear direction is set to be higher than that at the opposite ends thereof. The opposite axial ends of the charging roller CR are pressed toward the photoconductor drum PR by the springs 3. Due to a reactive force from the photoconductor drum PR, the midsection of the charging roller CR tends to bend in a direction away from the photoconductor drum PR, as compared with the opposite ends of the charging roller CR. If the charging roller CR bends, a contact area of the charge region Q0 in the circumferential direction may vary in the axial direction, possibly resulting in non-uniform charging performance in the axial direction. In contrast, in the abutment film 11 according to the first exemplary embodiment, the contact pressure is high at the midsection thereof and is applied in a direction for correcting the bending of the midsection of the charging roller CR. Thus, in the first exemplary embodiment, the charging performance may be readily made uniform in the axial direction, so that stable charging performance may be achieved, as compared with a case where the contact pressure at the midsection is not set to be high.

Second Exemplary Embodiment

Figure 6:
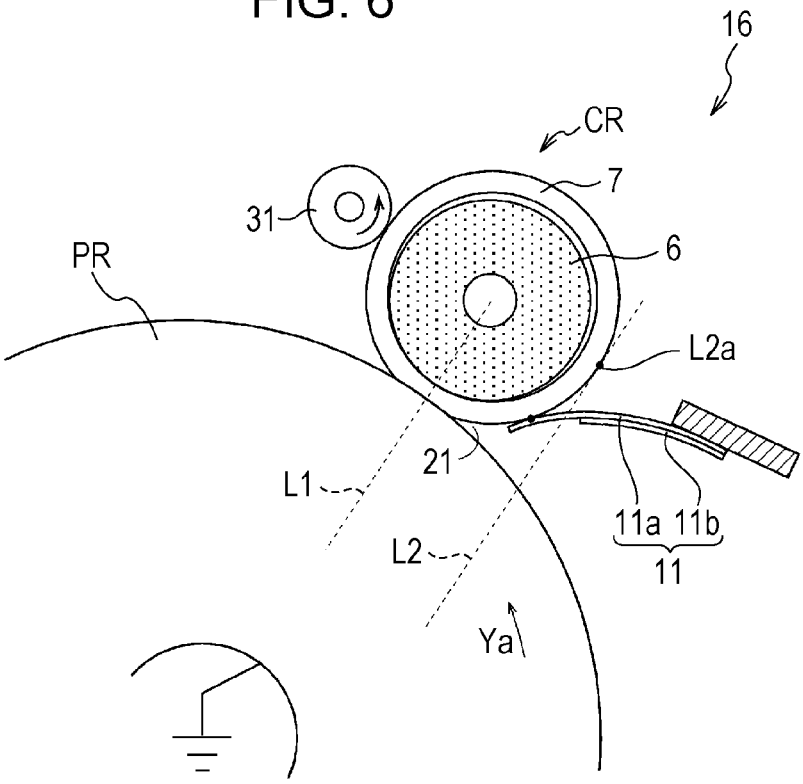
FIG. 6 illustrates a charging device according to a second exemplary embodiment and corresponds to FIG. 2 in the first exemplary embodiment.

FIG. 6 illustrates a charging device according to a second exemplary embodiment and corresponds to FIG. 2 in the first exemplary embodiment.

Although the second exemplary embodiment of the present invention will be described below, components in the second exemplary embodiment that correspond to the components in the first exemplary embodiment will be given the same reference characters, and detailed descriptions of such components will be omitted.

Although the second exemplary embodiment is different from the first exemplary embodiment in view of the following point, other points are similar to those in the first exemplary embodiment.

Referring to FIG. 6, in the copier U according to the second exemplary embodiment, a rotation roller 31 as an example of a contact member is disposed downstream of the charge region Q0 in the rotational direction of the charging roller CR. The rotation roller 31 according to the second exemplary embodiment is rotationally driven by transmitting thereto a driving force from a motor (not shown) as an example of a drive source. The rotation speed at the surface of the rotation roller 31 is set to be higher than or equal to the rotation speed of the charging roller CR.

Operation According to Second Exemplary Embodiment

In the charging device 16 according to the second exemplary embodiment having the above-described configuration, the surface layer 7 is pulled downstream in the rotational direction of the charging roller CR as the rotation roller 31 rotates. Thus, the behavior and the orientation of the surface layer 7 may be readily made stable also in the cuneiform-shaped space 21 located downstream of the charge region Q0. Consequently, more stable charging performance may be readily achieved, as compared with the first exemplary embodiment.

Modifications

Although the exemplary embodiments of the present invention have been described above, the present invention is not to be limited to the above exemplary embodiments and permits various modifications within the technical scope of the invention defined in the claims. Modifications H01 to H07 will be described below.

In each of the above exemplary embodiments, the copier U is described as an example of the image forming apparatus. Alternatively, in a first modification H01, each of the above exemplary embodiments may be applied to, for example, a printer or a facsimile apparatus as an example of the image forming apparatus, or to a multifunction apparatus having these multiple functions. Furthermore, each of the above exemplary embodiments is not limited to a monochrome image forming apparatus, and may alternatively be applied to a color image forming apparatus.

In each of the above exemplary embodiments, foamable EPDM is used as the elastic layer 6 as an example. Alternatively, in a second modification H02, the elastic layer 6 may be composed of a freely-chosen material that elastically deforms when pressed toward the photoconductor drum PR by the elastic force of the springs 3 and that is capable of widening a contact region, that is, a nip region, between the elastic layer 6 and the photoconductor drum PR. In this case, a formable material that may ensure a wide nip region even with weak springs 3 and that may also allow for reduced manufacturing cost is desired.

In each of the above exemplary embodiments, nylon or polyamide is used as the surface layer 7 as an example. Alternatively, in a third modification H03, the surface layer 7 may be composed of a freely-chosen material having a smooth surface that may correct non-uniform discharging in the foam material and also having resistivity for electrostatically charging the photoconductor drum PR.

In each of the above exemplary embodiments, PET in the form of a film is used as the contact member as an example. Alternatively, in a fourth modification H04, a freely-chosen material that comes into contact with the surface layer 7 and that is capable of applying tension to the surface layer 7 may be used. Moreover, the shape of the contact member is not limited to a film shape and may be changed to, for example, a brush shape, a roller shape, or a blade shape in accordance with, for example, design and specifications. Furthermore, the contact member may be used in combination with, for example, a cleaning blade, a cleaning brush, or a cleaning roller as an example of a cleaning member that cleans the surface of the surface layer 7.

In the above exemplary embodiments, although the contact positions of the abutment film 11 and the rotation roller 31 are desirably the positions shown as examples in the exemplary embodiments, the contact positions are not limited thereto. Specifically, in a fifth modification H05, the abutment film 11 may be set at a position farther away from the photoconductor drum PR relative to the contact point L2*a*.

In each of the above exemplary embodiments, the elastic layer 6 and the surface layer 7 constitute a two-layer structure as an example. Alternatively, in a sixth modification H06, a part of the elastic layer 6 may have a layered structure having two or more layers, and/or a part of the surface layer 7 may have a layered structure having two or more layers.

In each of the above exemplary embodiments, the charging device is described as an example of the applying device. Alternatively, for example, in a seventh modification H07, in a configuration having an intermediate transfer belt as an example of an image bearing member, each of the above exemplary embodiments may be applied to the transfer device as an example of the applying device that faces the intermediate transfer belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An applying device comprising:

an applying member that applies voltage to an image bearing member and has an elastic layer and an endless surface layer, wherein the elastic layer is disposed facing the image bearing member, is supported in a rotatable manner about a rotation axis, and is composed of a foam material, and wherein the surface layer is disposed so as to surround an outer periphery of the elastic layer, is supported by the elastic layer in a non-bonded state, and is rotatable together with the elastic layer; and a contact member that comes into contact with the surface layer at an upstream side, in a rotational direction of the applying member, relative to an imaginary line segment that connects a rotation axis of the image bearing member and the rotation axis of the applying member, so as to apply tension to the surface layer at a contact position between the image bearing member and the applying member, wherein the contact member comes into contact with the surface layer at a side of the rotation axis of the image bearing member relative to a contact point, the contact point being located upstream, in the rotational direction of the applying member, of the contact position between the applying member and the image bearing member and being where a second imaginary line segment comes into contact with the applying member, the second imaginary line segment being parallel to the imaginary line segment connecting the rotation axis of the image bearing member and the rotation axis of the applying member.

2. The applying device according to claim 1, wherein the contact member has opposite ends and a midsection in a direction in which the rotation axis extends, and wherein contact pressure with which the contact member comes into contact with the surface layer is set to be higher at the midsection than at the opposite ends.

3. An image forming apparatus comprising:

an image bearing member;

a charging device that includes the applying device according to claim 1 and that electrostatically charges a surface of the image bearing member;

a latent-image forming device that forms a latent image onto the surface of the image bearing member;

a developing device that develops the latent image on the image bearing member into a visible image;

a transfer device that transfers the visible image on the image bearing member onto a medium; and a fixing device that fixes the visible image transferred to the medium onto the medium.

4. An applying device comprising:

an applying member that applies voltage to an image bearing member and has an elastic layer and an endless surface layer, wherein the elastic layer is disposed facing the image bearing member, is supported in a rotatable manner about a rotation axis, and is composed of a foam material, and wherein the surface layer is disposed so as to surround an outer periphery of the elastic layer, is supported by the elastic layer in a non-bonded state, and is rotatable together with the elastic layer; and a contact member that comes into contact with the surface layer at an upstream side, in a rotational direction of the applying member, relative to an imaginary line segment that connects a rotation axis of the image bearing member and the rotation axis of the applying member, so as to apply tension to the surface layer at a contact position between the image bearing member and the applying member, wherein the contact member has opposite ends and a midsection in a direction in which the rotation axis extends, and wherein contact pressure with which the contact member comes into contact with the surface layer is set to be higher at the midsection than at the opposite ends.

5. An image forming apparatus comprising:

an image bearing member;

a charging device that includes the applying device according to claim 4 and that electrostatically charges a surface of the image bearing member;

a latent-image forming device that forms a latent image onto the surface of the image bearing member;

a developing device that develops the latent image on the image bearing member into a visible image;

a transfer device that transfers the visible image on the image bearing member onto a medium; and a fixing device that fixes the visible image transferred to the medium onto the medium.

* * * * *